US010689168B2

(12) United States Patent
Stolle

(10) Patent No.: US 10,689,168 B2
(45) Date of Patent: Jun. 23, 2020

(54) PLASTIC BOTTLE, IN PARTICULAR TOILET CLEANSER BOTTLE, AND ATTACHMENT AND BOTTLE CONTAINER FOR SUCH A PLASTIC BOTTLE

(71) Applicant: SHB GMBH, Crailsheim (DE)

(72) Inventor: Jens-Olaf Stolle, Crailsheim (DE)

(73) Assignee: SHB GmbH, Crailsheim (DE)

( * ) Notice: Subject to any disclaimer, the term of this patent is extended or adjusted under 35 U.S.C. 154(b) by 251 days.

(21) Appl. No.: 15/820,734

(22) Filed: Nov. 22, 2017

(65) Prior Publication Data

US 2018/0093801 A1 Apr. 5, 2018

Related U.S. Application Data

(63) Continuation of application No. PCT/EP2015/061905, filed on May 28, 2015.

(51) Int. Cl.

| | |
|---|---|
| ***B65D 50/02*** | (2006.01) |
| ***B65D 47/12*** | (2006.01) |
| ***B65D 1/02*** | (2006.01) |
| ***B65D 41/04*** | (2006.01) |
| ***B65D 41/16*** | (2006.01) |

(Continued)

(52) U.S. Cl.

CPC ..... *B65D 50/02* (2013.01); *B65D 1/0246* (2013.01); *B65D 1/32* (2013.01); *B65D 41/0414* (2013.01); *B65D 41/16* (2013.01); *B65D 47/06* (2013.01); *B65D 47/121* (2013.01); *B65D 47/122* (2013.01); *B65D 47/123* (2013.01); *B65D 50/046* (2013.01); *B65D 2251/04* (2013.01); *B65D 2501/0081* (2013.01)

(58) Field of Classification Search

CPC ..... B65D 1/0246; B65D 47/121; B65D 2501/0081; B65D 50/046; B65D 50/061

USPC ..... 215/244

See application file for complete search history.

(56) References Cited

U.S. PATENT DOCUMENTS 4,469,755 A 9/1984 Branchadell
4,775,078 A * 10/1988 Schick ..... B65D 1/32 222/212

(Continued)

FOREIGN PATENT DOCUMENTS

DE 19647260 A1 5/1998
DE 19824714 A1 4/1999

(Continued)

*Primary Examiner* — Anthony D Stashick
*Assistant Examiner* — Raven Collins
(74) *Attorney, Agent, or Firm* — Laurence A. Greenberg; Werner H. Stemer; Ralph E. Locher

(57) ABSTRACT

A plastic bottle, in particular a toilet cleanser bottle, has a bottle container, preferably formed by blow-molding, with a bottle neck and an angled attachment. The attachment is snapped onto the bottle neck in a direction of placement. The bottle neck has a first snap connection element and the attachment has a second snap connection element. In order to ensure a defined angular orientation between the angled attachment and the bottle container, an anti-rotation lock is formed between the attachment and the bottle neck, in particular between the two snap connection elements. To this end, preferably the snap connection elements engage positively with one another by way of toothings. Alternatively, an elevation having recesses is formed on a bottle shoulder for ensuring the anti-rotation lock.

17 Claims, 3 Drawing Sheets

(51) Int. Cl.

| | |
|---|---|
| ***B65D 1/32*** | (2006.01) |
| ***B65D 47/06*** | (2006.01) |
| ***B65D 50/04*** | (2006.01) |

(56) References Cited

U.S. PATENT DOCUMENTS

| | | | | |
|---|---|---|---|---|
| 5,060,827 | A * | 10/1991 | Segati | B65D 41/26 141/381 |
| 5,188,249 | A * | 2/1993 | Cargile | B65D 1/023 215/341 |
| 6,609,637 | B1 | 8/2003 | Suffa | |
| 7,100,785 | B1 | 9/2006 | Suffa | |
| 7,334,694 | B2 | 2/2008 | Suffa | |
| 2004/0245204 | A1 | 12/2004 | Suffa | |
| 2005/0103803 | A1 | 5/2005 | Hung et al. | |
| 2006/0060554 | A1 | 3/2006 | Garman | |
| 2006/0208003 | A1 | 9/2006 | Ophardt et al. | |
| 2009/0314811 | A1 | 12/2009 | Dennis | |
| 2010/0187195 | A1 | 7/2010 | Jamieson et al. | |
| 2012/0211457 | A1 | 8/2012 | Patel et al. | |

FOREIGN PATENT DOCUMENTS

| | | | |
|---|---|---|---|
| DE | 10051753 | A1 | 5/2001 |
| DE | 10207204 | A1 | 12/2002 |
| EP | 0059016 | A1 | 9/1982 |
| EP | 0217114 | A2 | 4/1987 |
| EP | 0343778 | A1 | 11/1989 |
| EP | 0909717 | A1 | 4/1999 |
| EP | 1383688 | A1 | 1/2004 |
| EP | 2522479 | A1 | 11/2012 |
| GB | 2131344 | A | 6/1984 |
| WO | 2012022475 | A1 | 2/2012 |

* cited by examiner

PLASTIC BOTTLE, IN PARTICULAR TOILET CLEANSER BOTTLE, AND ATTACHMENT AND BOTTLE CONTAINER FOR SUCH A PLASTIC BOTTLE

CROSS-REFERENCE TO RELATED APPLICATION

This application is a continuation, under 35 U.S.C. § 120, of international application No. PCT/EP2015/061905, filed May 28, 2015, which designated the United States; the prior application is herewith incorporated by reference in its entirety.

BACKGROUND OF THE INVENTION

Field of the Invention

The invention relates to a plastic bottle, in particular a bottle for toilet cleanser. The bottle comprises a bottle container having a bottle neck, and an attachment, in particular a metering attachment, which in a plug-fitting direction is snap-connected to the bottle neck, wherein the bottle neck has a first snap connection element and the attachment has a second snap connection element in order for the snap connection to be configured. The attachment is configured as an angular adapter attachment having an adapter neck that is oriented in angular manner to the bottle neck. The invention furthermore relates to an attachment and to a bottle container for a plastic bottle of this type.

A plastic bottle of this type is disclosed in my commonly assigned international patent application WO 2012/022475 A1, for example. That plastic bottle is a so-called toilet cleanser bottle which usually has a metering opening that is oriented in an angular manner. To this end, according to WO 2012/022475 A1, a special angular adapter attachment is plug-fitted onto a bottle neck of a bottle container. The adapter attachment per se has an adapter neck having the metering opening, wherein the adapter neck is oriented in an angular manner to the bottle neck of the bottle container. The advantage of this design embodiment is to be seen in that the bottle neck per se in relation to a longitudinal direction of the bottle container does not have to be configured in an angular manner. This simplifies the production of the bottle container which in particular in a simple manner can be configured as a blow molding.

A plastic bottle that is likewise configured in the manner of a toilet cleanser bottle can be derived from European patent EP 1 383 688 B1 and its counterpart U.S. Pat. No. 7,334,694 B2. That plastic bottle has a metering opening that is oriented in an angular manner. As opposed to WO 2012/022475 A1, in the case of the design embodiment described therein, the metering opening is achieved already by a special shaping of the bottle container, since the bottle neck is already oriented in an angular manner. A simple spray attachment having the metering opening is snap-connectable to this bottle neck in this instance. The metering opening per se is closable by screw-fitting on a closure cap. In order for a conjoint rotation of the attachment to be avoided in the screw-fitting of the closure cap, the attachment is plug-fitted onto the bottle neck so as to be secured against rotation. To this end, ribs are configured on the internal wall of the bottle neck.

SUMMARY OF THE INVENTION

It is accordingly an object of the invention to provide a plastic bottle which overcomes the above-mentioned and other disadvantages of the heretofore-known devices and methods of this general type and is a further improvement of a plastic bottle having an angular attachment, such as the one that is known from WO 2012/022475 A1.

With the foregoing and other objects in view there is provided, in accordance with the invention, a plastic bottle, in particular a bottle for toilet cleanser. The novel plastic bottle comprising:

a bottle container having a bottle shoulder and a bottle neck projecting from the bottle shoulder;

an attachment snap-connected, in a plug-fitting direction, with the bottle neck, the bottle neck having a first snap connection element and the attachment having a second snap connection element;

the attachment being an adapter attachment having an adapter neck for plug-fitting a closure cap; and an anti-rotation feature configured between the attachment and the bottle container.

In other words, the novel plastic bottle comprises a bottle container having a bottle shoulder from which a bottle neck projects. The plastic bottle furthermore comprises an attachment that is snap-connected to the bottle neck. The bottle neck herein has a first snap connection element and the attachment has a second snap connection element in order for the snap connection to be configured. The attachment herein is snap-connected in a plug-fitting direction. In the snap-connected state the two snap connection elements in the plug-fitting direction engage behind one another. The attachment is an angular adapter attachment which has an adapter neck for plug-fitting a closure cap, wherein the adapter neck is oriented in an angular manner to the bottle neck of the bottle container and thus also to the plug-fitting direction, or else to a central axis of the bottle neck of the bottle container. Additionally, it is furthermore provided that an anti-rotation feature is configured between the attachment and the bottle neck.

The design embodiment having the integrated anti-rotation feature of the angular attachment herein is based on the concept that the attachment in relation to the bottle container should be aligned in a defined rotational orientation on the bottle neck. In principle, this is readily possible at first when snap-connecting the attachment by way of a filler which also fills the bottle container and subsequently snap-connects the attachment. However, in the absence of an anti-rotation feature there is the risk of the attachment being rotated in transit, in sales premises, or else later at the consumer, on account of which the comfort aspect is compromised.

This integrated anti-rotation feature therefore serves for guaranteeing a defined preferred orientation which the adapter should assume in relation to the bottle container. Therefore, any subsequent accidental and inadvertent rotation of the attachment in relation to the bottle container is avoided on account of the anti-rotation feature, and the rotational orientation in relation to the bottle container, once set, is further maintained. The bottle container usually has an approximately oval basic shape, and the attachment is usually angular in the direction of the longitudinal axis of the oval cross section.

The adapter neck in general preferably has a metering opening. Furthermore, the closure cap is in particular screw-fittable onto the bottle neck. However, a snap-connection is also possible, in principle. The bottle neck therefore selectively has a screw thread or a further snap closure element.

On account of this angular embodiment there is firstly also no fundamental requirement for a securing feature in order for a conjoint rotation of the attachment to be avoided when a closure cap is screw-fitted onto the adapter neck, for example. The angle enclosed by the adapter neck to the bottle neck is indeed sufficiently large and is in the range of, for example from 20 to 45°, and in particular in the range from 30 to 35°. A conjoint rotation of the attachment is already avoided on account thereof by way of the principle of the angular attachment, such that there is at first no impetus for an anti-rotation feature such as described in U.S. Pat. No. 7,334,694 B2 and EP 1 383 688 A1 to be used in order for such a conjoint rotation to be avoided. The present integrated anti-rotation feature serves another purpose, specifically that of maintaining a preferred orientation of the attachment which as a consequence of the angular design embodiment is non-symmetrical.

According to one preferred refinement, two different anti-rotation features that are effective in a mutually independent manner are configured. This is to be understood that the two anti-rotation features differ in terms of their constructive design embodiment. A total anti-rotation feature that in overall terms is redundant is configured on account of this measure. This is of particular advantage in particular in view of a required child-proof feature. A rotation of the adapter in relation to the bottle container is reliably precluded on account of this redundant anti-rotation feature. A rotation of this type could otherwise lead to the adapter being released from the bottle neck in an undesirable manner.

Additionally to this child-proof feature that acts between the adapter attachment and the bottle container, a further child-proof feature is furthermore expediently configured between the adapter attachment and a closure cap.

In order for the anti-rotation feature to be configured, various alternatives, in particular also in a combined manner, are preferably employed herein. The alternatives for the anti-rotation feature, which will yet be described in detail hereunder, are fundamentally employable also in the case of symmetrical non-angular attachments. That is, the attachment being an angular adapter attachment, is a particularly preferred embodiment of the invention, but the other variants of the invention do not necessarily require the angularity.

The common feature of the alternatives for the anti-rotation feature, which are described hereunder, is that the alternatives are not configured on an internal shell surface of the bottle neck. Anti-rotation features of this type which are configured on the internal wall influence the flow cross-section of the liquid that is contained in the bottle.

In order for the anti-rotation feature to be configured, it is provided selectively or in a combined manner in preferred refinements that

- the two snap connection elements engage in one another in such a manner that the snap connection elements as a first anti-rotation feature configure a form-fit that acts in the circumferential direction;
- a toothing as a second anti-rotation feature is configured circumferentially on the bottle neck;
- the bottle shoulder has an elevation which conjointly with the attachment as a third anti-rotation feature configures a form-fit that acts in the circumferential direction.

In the case of the first anti-rotation feature alternative, the two snap connection elements engage in one another in a form-fitting manner in order for the anti-rotation feature to be configured. To this end, the snap connection elements configure in particular a first toothing. Therefore, the snap connection elements are assigned a double function; specifically, the snap connection elements on the one hand serve for the actual fastening of the attachment to the bottle neck by way of the snap connection, and on the other hand the anti-rotation feature is simultaneously achieved by way of the snap connection elements.

In order for the second anti-rotation feature to be configured, a second toothing which is configured directly on the bottle neck, in particular specifically above the snap connection element, is provided. Such a second toothing is easy to produce in terms of production technology. The bottles described here are usually so-called blow-molded bottles. The second anti-rotation feature, as well as the first anti-rotation feature, can be implemented in a cost-effective manner by way of a toothing that is already prepared on the blow-molding preform.

An upper region of the bottle container at the end side, which usually is configured so as to be substantially horizontal or slightly curved, is in general understood to be a bottle shoulder. The attachment is typically supported on this bottle shoulder.

In order for an efficient anti-rotation feature to be configured in the case of the third alternative, this bottle shoulder has an elevation which is dimensioned in such a manner that the elevation by configuring a form-fit with the plug-fitted attachment configures an effective anti-rotation feature. The elevation and at least part-regions of the (internal) shell surface of the attachment thus engage in one another. The elevation is therefore dimensioned to a sufficient size and preferably extends by a plurality of millimeters in the plug-fitting direction. The height of this elevation that is provided for the form-fit is therefore preferably in the range between 2 and 5 mm, in particular approximately 3 mm. The elevation herein, proceeding from the bottle neck, extends in the radial direction up to the circumferential contour of the elevation.

This specially shaped elevation is usually produced only in the blow-molding procedure, thus when the blow-molding preform is inflated in a respective mold and, on account thereof, assumes the shape of the bottle shape that is predefined by the mold.

In a preferred design embodiment the second and the third variant of the anti-rotation features are combined with one another, that is to say a toothing is configured on the bottle neck, and the third anti-rotation feature is additionally configured on the bottle shoulder. A reliable redundant anti-rotation feature that is easy to produce is configured on account thereof.

In order for the third anti-rotation feature to be configured, the elevation in a preferred design embodiment circumferentially has at least one and expediently a plurality of concavities, for example 2 to 6 concavities, in which the attachment by way of a corresponding burl engages in order for the anti-rotation feature to be configured. A form-fit which acts in the circumferential or rotational direction about the plug-fitting direction is configured between the concavity and the burl. In general, therefore, mutually corresponding securing elements that extend in the radial direction and engage in one another are thus configured on the elevation and on the attachment. A radial securing element herein is understood to mean that these securing elements have an extent in the direction toward the central axis of the bottle neck and in a corresponding manner mutually overlap also in the circumferential or rotational direction.

Alternatively or additionally it is expediently provided that the elevation when viewed in the cross section has a circumferential contour that deviates from the circular shape, the attachment bearing on the non-circular circumferential shape in order for the anti-rotation feature to be configured. The possibility for an anti-rotation feature to be configured already exists solely on account of the design embodiment of the elevation and the non-rotationally symmetrical design embodiment of the elevation. This in particular by virtue of the comparatively great height of the elevation of a plurality of millimeters.

This circumferential contour that deviates from the circular shape and is in particular formed by a polygonal structure optionally having rounded corners is preferably employed in combination with the radial securing elements.

The elevation herein in relation to a rotation about the central axis and thus about the plug-fitting direction by 180° is expediently configured to be overall non-symmetrical. The elevation herein, when viewed in the plan view, is configured in particular in the manner of a trapeze. A preferred orientation of the attachment in relation to the bottle container is already established and a correct assembly is thus ensured on account of this design embodiment. An unequivocal orientation in the assembly is predefined by way of this type of non-symmetrical design embodiment. At the same time, the anti-rotation feature is also configured by way of the polygonal design embodiment, such that a double function is achieved in the case of this variant of embodiment.

In order for the desired rotational orientation in relation to the bottle container to be able to be set in as precise a manner as possible in the first snap connection of the attachment, a rotationally fixed positioning of the attachment in relation to the bottle neck is enabled in rotational steps of preferably less than or equal to 5° in a preferred variant. This design embodiment is based on the concept that in the case of the preferred design embodiment of the bottle container as a blown molding, a defined rotational orientation between the attachment and the bottle neck cannot be mandatorily set in advance by way of a defined arrangement of individual discrete anti-rotation feature elements. This defined rotational orientation in the case of some variants can only be set when plug-fitting. The reason therefor is to be seen in the production process of the blow molding. In the case of the latter, preforms are inflated in a bottle container mold in order for the bottle container that is provided with the preferred orientation (oval body) to be configured. The preforms (blow-molding preforms) herein already have the typically circular bottle neck having the first snap closure element. A cylindrical body adjoins the bottle neck. However, in blow molding per se the preform if at all can be gripped at a defined rotational orientation and incorporated into the blow mold only with a significant technical complexity. Therefore, it is usually complex for a defined orientation between an anti-rotation feature that is attached to the bottle neck and the preferred orientation of the bottle container to be produced already in this production step. This design embodiment having the positioning capability in small rotational steps is therefore employed in particular in the case of the first or the second anti-rotation feature variant, in which the anti-rotation feature elements are configured on the snap connection elements or on the bottle neck. In the case of the variant having the elevation, the desired direction usually is preferably set precisely by the negative shape of the elevation in the bottle container mold.

In order for this rotation to be enabled in as small steps as possible, in each case one toothing having a plurality of teeth is provided in an expedient design embodiment, the attachment and the bottle neck engaging in one another by way of the toothing. In the case of the first toothing the teeth are expediently configured directly on the snap connection elements.

In the case of the second toothing which is configured directly on the bottle neck and not on the snap connection elements, the second teeth herein are preferably configured on the external side on the shell of the bottle neck such that the free flow cross section is not compromised.

An at least largely continuous toothing for setting the desired rotational orientation in as small steps as possible is generally provided on the circumference at least in the case of one of the two elements (attachment or bottle neck, respectively). In one preferred design embodiment, a different number of teeth are configured on the attachment and on the bottle neck. In particular, only a very limited number of teeth are configured in the case of one of these two elements.

According to one expedient refinement, the first or also the second toothing herein extends only across a part-region of the circumference. In particular, two, three, or four annular toothed segments that are uniformly distributed about the circumference are configured on the bottle neck and/or on the attachment.

According to a preferred first variant of the first anti-rotation feature, the snap connection elements engage in one another in the plug-fitting direction in order for the first toothing to be configured. To this end, teeth are configured in particular on a lower side of the first snap connection element. The lower side is engaged from behind by a corresponding upper side of the second snap connection element of the attachment. Teeth are also configured in a corresponding manner on the upper side of the second snap connection element.

In an alternative second variant of the first anti-rotation feature, the two snap connection elements engage in one another in the radial direction. Therefore, the teeth here are disposed circumferentially on the external circumference of the first snap connection element. However, the teeth on the second snap connection element are henceforth configured on the upper side of the second snap connection element, specifically circumferentially on the shell internal side of the attachment.

The first toothing, at least on one snap element, preferably extends in an encircling manner across the entire circumference. Alternatively, the first toothing extends only across a certain angle of rotation.

The snap connection elements herein are preferably configured as a ring or also as a plurality of annular segments. The annular segments herein are disposed so as to be distributed across the entire circumference. For example, three or four annular segments that are disposed in a uniformly distributed manner are configured. A void which extends across an angle of rotation of, for example, from 10° to 25°, is configured between the individual annular segments. Snap-fitting per se is facilitated by the segmented configuration, since an elastic deflection of the second snap element of the attachment is required when snap-fitting. The segmented configuration herein is configured only in the case of the first or in the case of the second snap connection element, for example, wherein the other snap connection element is annular. Alternatively, both snap connection elements are configured as annular segments.

In a manner corresponding to the preferred field of application as a WC bottle having an angular adapter attachment, both the bottle container as well as the attachment in an expedient design embodiment have a preferred orientation in relation to a rotation about the plug-fitting direction, and the attachment is snap-fitted in a planar manner in a predefined rotational orientation in relation to the bottle container.

As has already been explained, the basic bottle body is preferably a blown molding which is produced by means of blow molding.

With the above and other objects in view there is also provided, in accordance with the invention, a plastic bottle, in particular an angled-neck bottle for toilet cleanser, the bottle comprising:

a blow-molded bottle container formed from a blow-molding preform, the bottle container having a bottle neck;

a holding collar configured for holding and conveying the blow-molding preform while being blow-molded to form the bottle container; and the holding collar having at least one, or a plurality of, first positioning elements.

This further design embodiment is based on the concept that a cost-effective production method for hollow bodies in general and for bottles in particular is blow molding, in particular injection/(stretch) blow molding. In the case of the latter, a preform is first generated by injection molding, said preform subsequently being completed to form a bottle by way of a stretch blow-molding procedure. This method is employed in particular in the case of so-called PET bottles. However, this cost-effective method usually does not permit the production of complex geometries such as, for example, angular bottle necks. Therefore, the use of an angular attachment such as is described in WO 2012/022475 A1, for example, is provided.

According to the invention, it is henceforth provided that first positioning elements which in particular extend in the radial direction and are formed in particular by two opposite recesses are configured on a holding collar which in the case of blow-molding preforms is usually used for handling (gripping, transporting, . . . ) the latter.

These positioning elements, on the one hand, serve for aligning the blow-molding preform in a defined manner in the blow mold, such that the asymmetrical, for example oval, design embodiment of the bottle body is configured in a defined orientation in relation to the first positioning element.

Additionally, second positioning elements of an attachment, for example an angular neck adapter as has been described previously or in WO 2012/022475 A1, engages, in particular in a latching manner, in the first positioning elements. On account thereof, a defined orientation of the attachment in relation to the asymmetrical bottle is guaranteed.

At the same time, an anti-rotation feature is preferably also configured hereby such that a third alternative variant for the configuration of an anti-rotation feature is to be seen on account thereof.

The mutually corresponding positioning elements on the holding collar, on the one hand, and on the attachment, on the other hand, in a corresponding manner are expediently configured such that said positioning elements engage in one another in a form-fitting and in particular in a latching manner. The form-fitting direction herein is preferably configured so as to be effective in the circumferential direction such that the desired anti-rotation feature is achieved on account thereof.

As is the case also with the variants of embodiment described above, the bottle body here expediently is also not rotationally symmetrical but has a preferred direction. At the same time, the attachment is also not rotationally symmetrical and has a preferred direction, said attachment being configured in particular as an angular attachment having a metering opening. The attachment therefore is in particular the angular neck adapter described above.

Alternatively, the attachment here can also be a simple closure cap.

This variant of embodiment having the design embodiment of the positioning elements on the holding collar herein is expediently employable both in the case of snap connection closures as well as in the case of screw-fitting closures, thus in the case of variants of embodiment in which the attachment is selectively snap-connected or screw-fitted.

On account thereof, a defined alignment of the attachment in relation to the bottle body, in particular also in the case of automated assembling, is guaranteed in an overall simple manner.

This third variant described here for the anti-rotation feature can be combined with one or both of the design embodiment according to the invention of the anti-rotation feature described above. In particular, the different variants described here for the anti-rotation feature are employed also in arbitrary combinations.

Other features which are considered as characteristic for the invention are set forth in the appended claims.

Although the invention is illustrated and described herein as embodied in a plastic bottle, in particular a bent-neck bottle, and attachment and bottle container for such a plastic bottle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Parts having equivalent functions are in each case provided with the same reference signs in the figures.

DETAILED DESCRIPTION OF THE INVENTION

Figure 1:
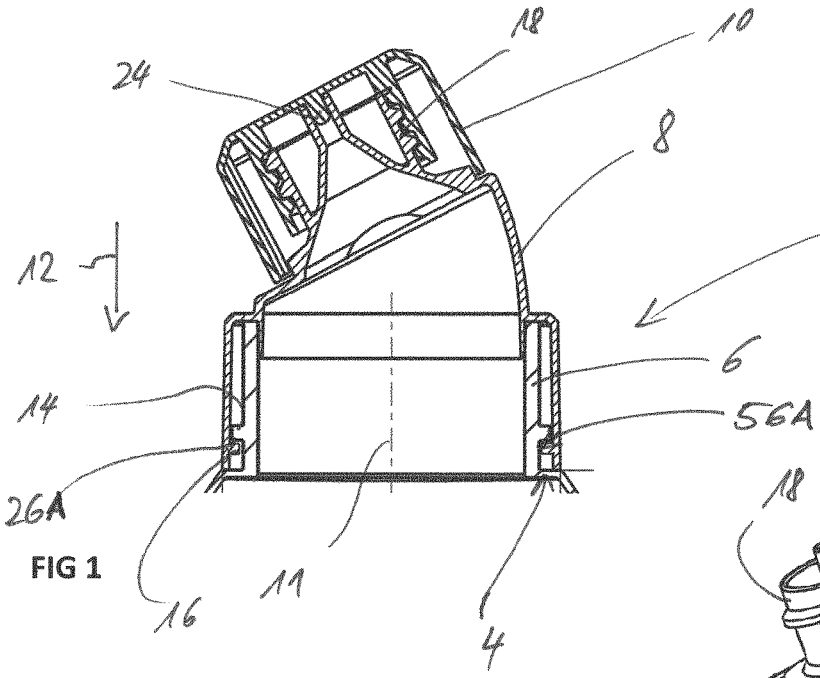
FIG. 1 shows a fragmented sectional illustration of a plastic bottle in the upper region of a bottle neck and of an attachment plug-fitted thereon, having a closure cap screw-fitted thereon.

Referring now to the figures of the drawing in detail and first, particularly, to FIG. 1 thereof, there is shown a plastic bottle 2, in particular a bottle for a toilet cleanser, illustrated in only a fragmented manner in the upper region in FIG. 1, has a bottle container 4 having a bottle neck 6 and an angular attachment 8 that is configured as an attachment adapter, and finally a closure cap 10. The attachment 8 herein in the direction of a plug-fitting direction 12 is snap-connected to the bottle neck 6. The plug-fitting direction 12 herein at the same time corresponds also to an axial or longitudinal direction of the plastic bottle 2, or of the bottle container 4, a central axis 11 of the bottle neck 6 extending along said axial or longitudinal direction. In order for the snap closure to be configured, an annular first snap closure element 14 is configured on the outside on the shell of the bottle neck 6 and, in a corresponding manner thereto, a second annular segment or a annular segment-type snap closure element 16 is configured on the inside on an internal shell of the attachment 8. Both the attachment 8 as well as the bottle neck 6, at least in the region of the snap closure elements 14, 16, have a circular cross-sectional geometry. In the snap-fitted state such as is illustrated in FIG. 1, the first snap closure element 14 in the plug-fitting direction 12 is engaged from behind by the second snap closure element 16. In order to be plug-fitted, the snap closure elements 14, 16 are mutually deflected in an elastic manner, thus configuring a type of snap connection.

Figure 2:
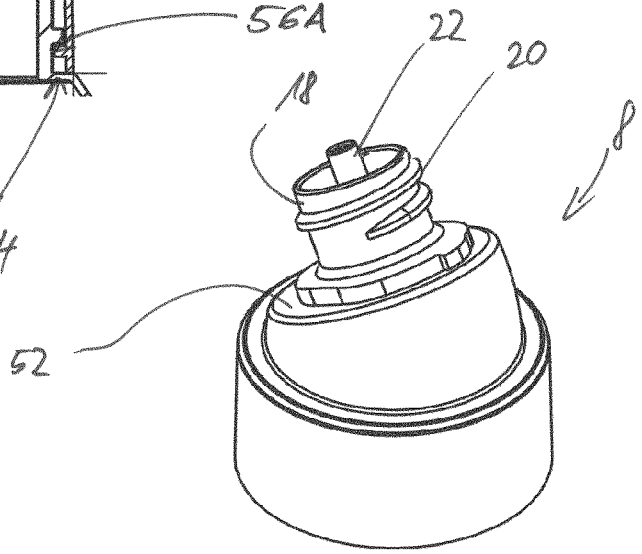
FIG. 2 shows the attachment according to FIG. 1 in a perspective illustration.

As can be derived in particular from FIGS. 1 and 2, the attachment 8 per se in turn has an adapter neck 18 which is oriented in an angular manner in relation to the plug-fitting direction 12, and which is furthermore provided with a thread 20 and a metering element 22. The closure cap 10 by way of an internal thread is screw-fitted to the thread 20 (FIG. 1), said closure cap 10 having a closure plug 24 which engages in the metering element 22.

Figure 5:
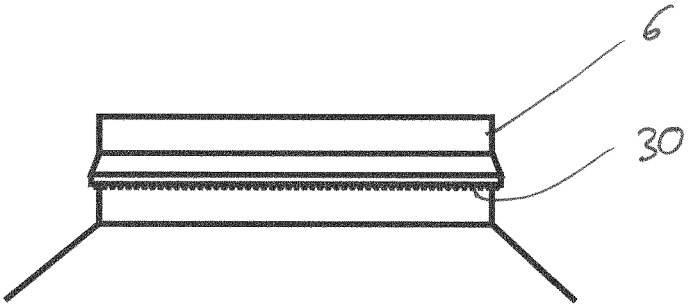
FIG. 5 shows a bottle container having a bottle neck and having a first anti-rotation feature having a first snap connection element that is configured with first teeth, in a simplified fragmented illustration.
Figure 6:
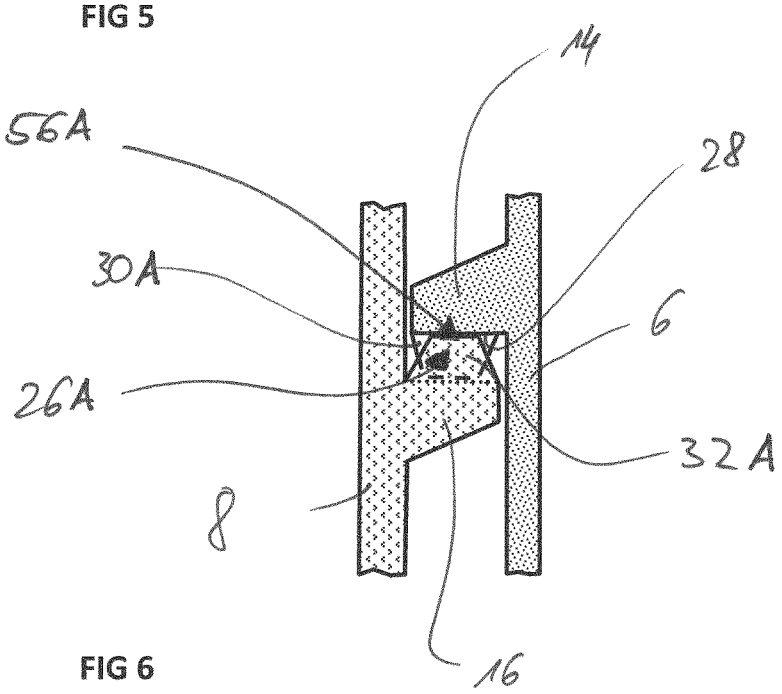
FIG. 6 shows a fragmented sectional illustration in the region of a first toothing between snap closure elements of the attachment and of the bottle neck.

In order for an anti-rotation feature to be configured between the attachment 8 and the bottle neck 6, a first toothing 26A such as is schematically drawn in a fragmented illustration in FIGS. 5 and 6 is configured between the two snap closure elements 14, 16 in the exemplary embodiment of FIG. 1. The first toothing 26A herein is configured between the two snap closure elements 14, 16.

Figure 3:
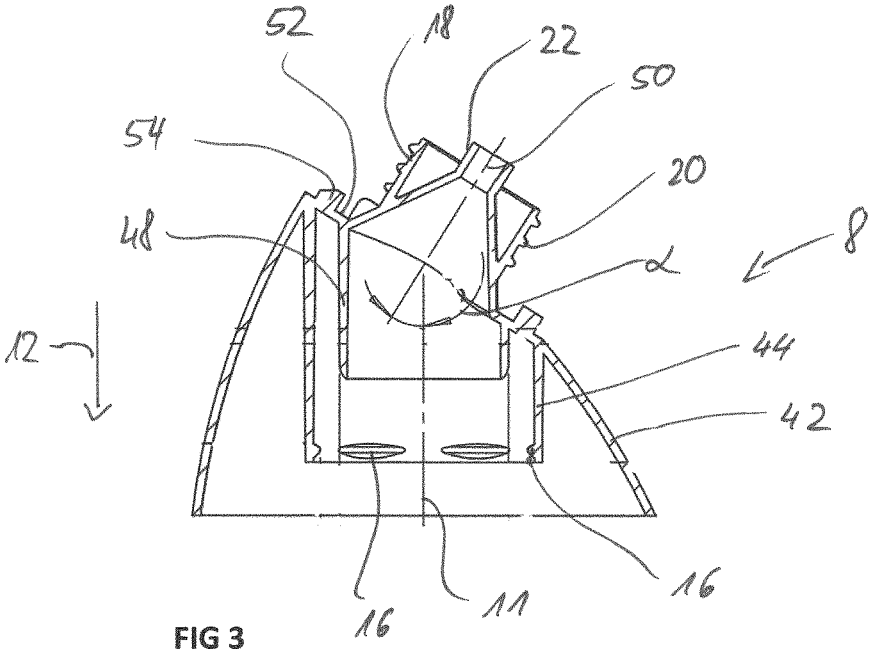
FIG. 3 shows a sectional illustration of an alternative variant of the attachment.
Figure 4:
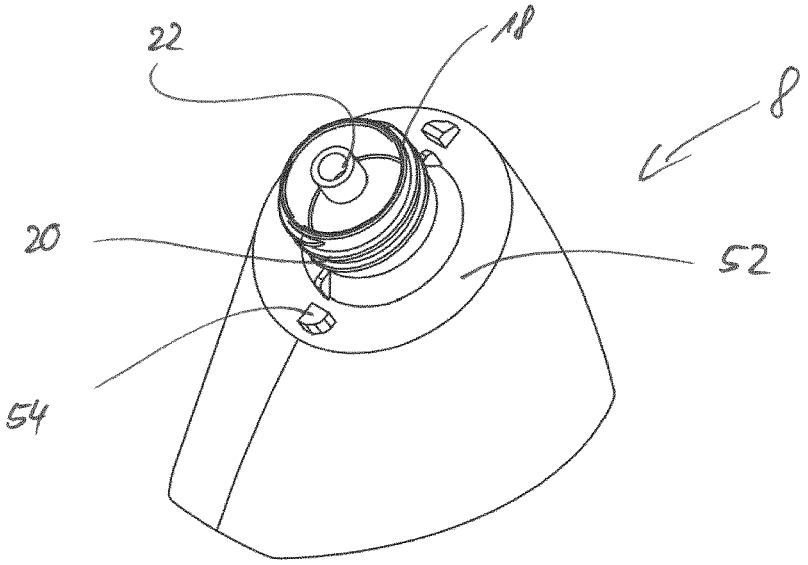
FIG. 4 shows the attachment according to FIG. 3 in a perspective illustration.
Figure 7:
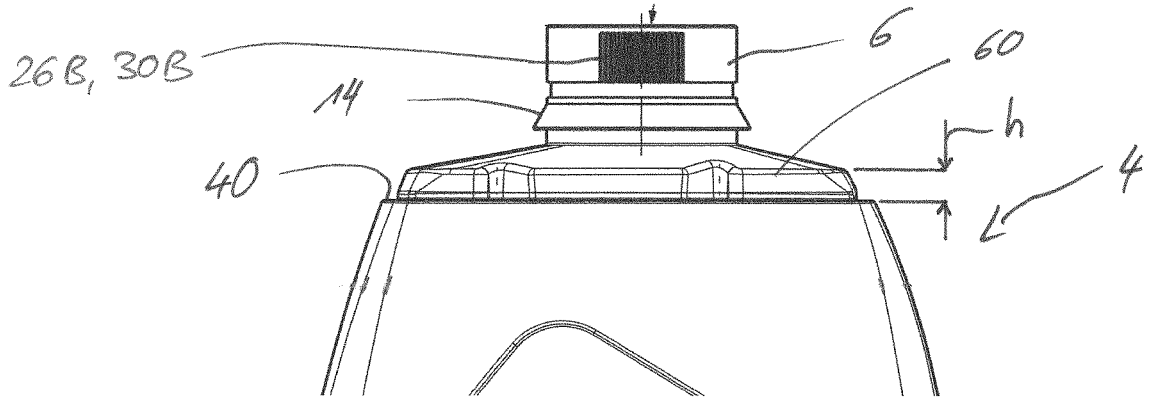
FIG. 7 shows a fragmented illustration of a bottle container having a second toothing on the bottle neck and having an elevation on a bottle shoulder, in order for a second and a third anti-rotation feature to be configured.
Figure 8:
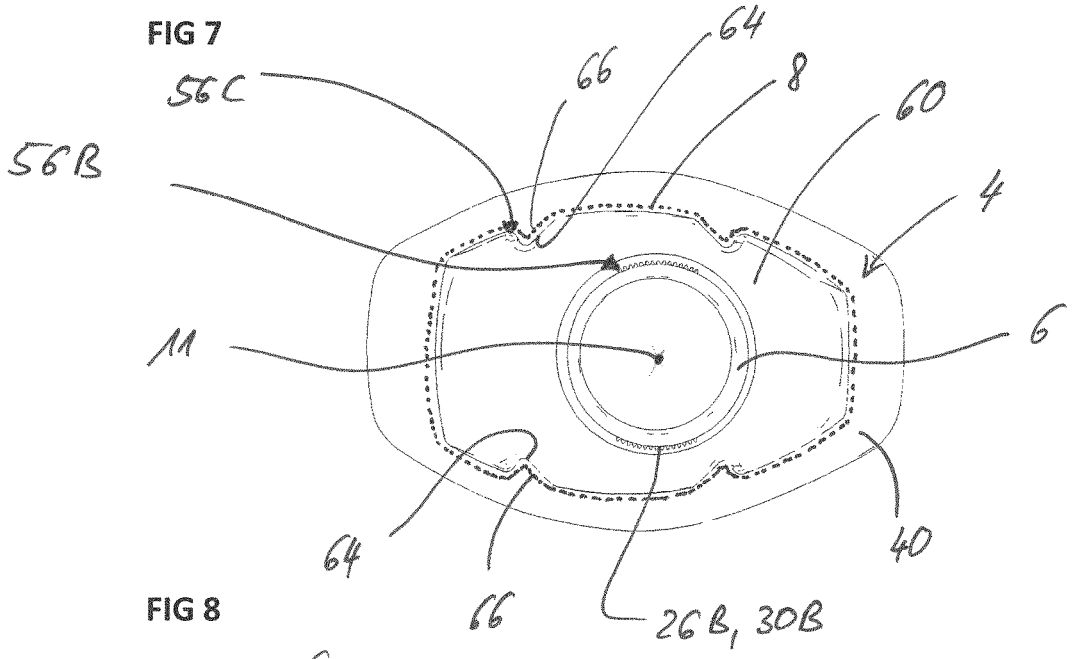
FIG. 8 shows a plan view of the bottle container according to FIG. 7.

An alternative embodiment of the attachment 8 is illustrated in FIGS. 3 and 4. A substantial difference to the variant of embodiment according to FIGS. 1 and 2 is first to be seen in that this attachment does not have a circular base area by way of which the attachment 8 comes to bear on a bottle shoulder 40 (FIGS. 7, 8). Rather, the attachment 8 has an approximately trapezoidal base area, wherein the individual sides of the trapeze, in particular the longitudinal sides, are configured in an arcuate manner. An attachment 8 of this type is used in particular in combination with the bottle container 4 such as is described in the context of FIGS. 7 and 8. Accordingly, the approximately trapezoidal contour of the base area of the attachment 8 is also illustrated in a punctiform manner in FIG. 8. Overall, the base area by virtue of the convexly bent lateral faces is formed by a type of trapezoidal oval.

As can be derived in particular from the sectional illustration of FIG. 3, the attachment 8 is configured in a double-shelled manner, having an external shell 42 which extends up to the bottle shoulder 40 and defines the non-circular geometry of the base area. At the same time, an internal collar 44 by way of which the attachment 8 is push-fitted over the bottle neck 6 is configured. This internal collar 44 exhibits the second snap closure elements 16. The internal collar 44 herein is oriented so as to be concentric with the central axis 11. An introduction collar 48 which is likewise configured so as to be concentric with the central axis 11 and which typically sits in a sealing manner on an opening of the bottle neck 6 and partially protrudes into the latter is additionally configured. To this end, the introduction collar 48 on the end sides has chamfered sealing faces.

Furthermore, a bending angle $\alpha$ between the central axis 11 of the bottle neck 6 and a respective oblique axis 50 of the adapter neck 18 and of the metering element 22 can be readily derived by means of FIG. 3. This bending angle $\alpha$ herein is preferably in the range between 25 and 40 degrees.

Furthermore, an adapter shoulder 52 is oriented in relation to the bottle shoulder 40 at this bending angle $\alpha$. Furthermore, elements for configuring a child-proof feature 54 are disposed on this adapter shoulder 52. A child-proof feature in the region of the adapter shoulder 52 is also configured in the case of the variant of embodiment according to FIGS. 1 and 2.

In each case an anti-rotation feature is configured between the attachment 8 and the bottle container 4. Different variants thereof will be explained in more detail hereunder by means of FIGS. 5 to 10, said variants being referred to as the first, second, and third anti-rotation feature 56A,B,C. In principle, the different variants described can be applied to both attachment types. The attachments 8 and the bottle containers 4, in view of the respective variant of the anti-rotation feature, are configured so as to be mutually complementary.

Figure 9:
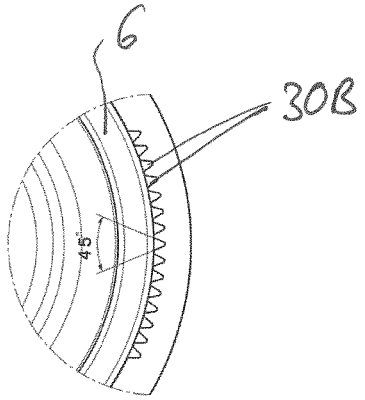
FIG. 9 shows an illustration, enlarged in fragments, of the plan view of the bottle container according to FIG. 8.

One preferred design embodiment which shows a combined variant having two different variants of the anti-rotation feature is described in the context of FIGS. 7 to 9.

The first anti-rotation feature 56A is described in the context of FIG. 1 and in particular to FIGS. 5 and 6. As can be derived from FIG. 5, the first snap closure element 14 in the exemplary embodiment is configured in an encircling manner as a continuous snap ring on the external shell of the bottle neck 6. The snap ring herein in a first part spreads in a conical manner in the plug-fitting direction 12, prior to a cylindrical part then adjoining the former. A first toothing having a multiplicity of first teeth 30A is configured on the lower side 28 of said snap ring.

In a similar design embodiment, a toothing having a multiplicity of complementary first teeth 32A is also configured in the case of the second snap closure element 16, as can be derived from FIG. 6. In this case, the complementary first teeth 32 are configured on an upper side 34 of the second snap closure element 16. The second snap closure element is preferably configured only in an annular-segment manner such that a simplified elastic deflection when snap-fitting is enabled. The second snap closure element 16 also has a conically-running lower side such that the two conical regions can slide on one another when snap-fitting.

As can be seen from FIG. 6, the teeth 30A, 32A engage in one another in the plug-fitting direction 12, and on account thereof configure a first toothing 26A and thus the first anti-rotation feature 56A that acts in the circumferential direction.

In order for the desired fine adjustability of the rotational orientation of the attachment 8 in relation to the bottle neck 6 to be guaranteed, the first teeth 30A or 32A, respectively, are preferably disposed at a mutual spacing in terms of an angle of rotation of approximately 5° maximum.

One preferred variant of embodiment in which a second anti-rotation feature 56B is combined with a third anti-rotation feature 56C is illustrated in FIGS. 7 to 9.

In order for the second anti-rotation feature 56B to be configured, a second toothing 26*b* is configured in the assembled state on the bottle neck 6, specifically on the cylindrical part thereof above the first snap closure element. To this end, the bottle neck 6 on the cylindrical external shell face thereof has a number of second teeth 30B which in the manner of part-segments extend along the circumferential side on two opposite part-regions. Therefore, two opposite tooth regions are configured. Said opposite tooth regions in the exemplary embodiment extend in each case across a limited angular range from, for example, 30° to 60°, and in particular across an angular range of approximately 45°. The second teeth 30B herein extend so as to be parallel with the central axis 11. Said second teeth 30B, when viewed in the cross section (cf. in particular FIG. 9 in this context), have an approximately triangular base area having a flattened tip of the triangle. The two triangle flanks herein are mutually oriented preferably at an angle between 30° and 60°, and preferably at an angle of 45°.

Accordingly, complementary teeth which likewise preferably have a cross-sectional shape of this type are attached to the attachment 8. Said complementary teeth engage in the second teeth 30B (not illustrated) in a form-fitting manner.

A third anti-rotation feature 56C is additionally configured in the case of the variant of embodiment according to FIGS. 7 to 9. To this end, an elevation 60 is configured on the bottle shoulder 40. Said elevation preferably has a height h which is in the range from 2 to 5 mm, in particular is 3 mm. In principle, such an elevation can also be configured in the case of the variant according to FIGS. 5 and 6.

The elevation 60 in general first has a non-circular basic shape and, accordingly, a non-circular circumferential contour 62. The basic shape of this circumferential contour 62, in a manner corresponding to the base area of the attachment 8 according to FIGS. 3, 4, is likewise configured so as to be trapezoidal having convexly bent lateral faces. The internal wall of the external shell 42 of the attachment 8 herein in a fully circumferential manner bears directly on the circumferential contour 42.

As can furthermore be derived from FIG. 8, the elevation 60 has concavities 64 which extend approximately in the direction toward the central axis 11 and are thus to be seen as radial first anti-rotation feature elements. In a manner corresponding thereto, the attachment 8 also has burls 66 that extend in the radial direction and can be seen as second anti-rotation feature elements.

A plurality, in particular two, radial securing elements of this type are configured on each convexly bent longitudinal side of the trapezoidal basic shape in the exemplary embodiment. Said securing elements are expediently provided with an approximately triangular base area, wherein the one leg of the triangle is longer than the other such that a scalene triangle is formed. The two anti-rotation feature elements that are disposed on one longitudinal side herein are disposed in a mutually mirror-imaged manner, specifically in such a manner that the steeper triangle flank is in each case oriented toward the shorter sides of the trapeze.

Figure 10:
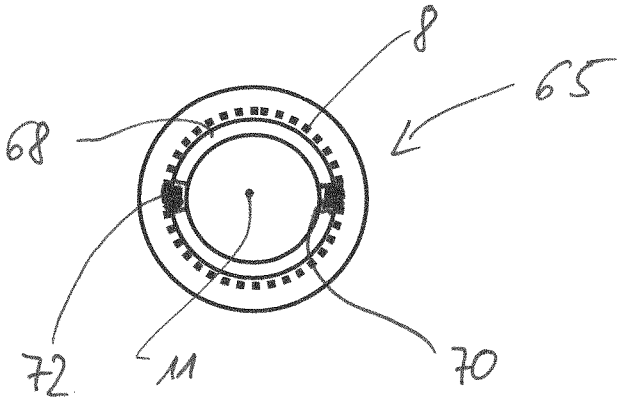
FIG. 10 shows a plan view of a blow-molding preform having positioning elements that are configured on a holding collar.

Finally, a further design embodiment is schematically drawn by means of FIG. 10. FIG. 10 herein, in a heavily simplified illustration, shows a plan view of a blow-molding preform 65 that in the cross section is usually circular, the bottle container 4, illustrated in FIGS. 7 and 8, having the non-circular cross-sectional shape being usually produced from said blow-molding preform 65. The bottle neck 6 having the first snap closure element 14 and, if required, having the second teeth 30A,B for the toothings 26A,B is preferably already configured on the blow-molding preform 65 (in a manner not illustrated here).

Said blow-molding preform 65 in the region of the bottle neck 6 typically has a holding collar 68. The holding collar 68 is resorted to for handling the blow-molding preform 65 for the blow-molding procedure.

It is henceforth to be highlighted that the holding collar 68 per se has at least one and in the exemplary embodiment two opposite positioning elements 70 in the form of recesses. In the completed design embodiment in the case of a plug-fitted attachment 8, preferably corresponding second positioning elements 72 of an attachment 8 (illustrated in dashed lines here) engage in these first positioning elements 70. An anti-rotation feature is configured on account thereof.

Independently of such an anti-rotation feature, the first positioning elements 70 are expediently resorted to in order for the blow-molding preform to be aligned as precisely as possible in a blow mold, such that a fixed correlation is set between the positioning elements 70 and the non-symmetrical shape of the bottle container 4.

The following is a summary list of reference numerals and the corresponding structure used in the above description of the invention:

2 Plastic bottle
4 Bottle container
6 Bottle neck
8 Attachment
10 Closure cap
11 Central axis
12 Plug-fitting direction
14 First snap closure element
16 Second snap closure element
18 Adapter neck
20 Thread
22 Metering element
24 Closure plug
26A,B First, second toothing
28 Lower side
30A,B First, second teeth
32A Complementary first teeth
34 Upper side
40 Bottle shoulder
42 External shell
44 Internal collar
48 Introduction collar
50 Oblique axis
52 Adapter shoulder
54 Child-proof feature
56A,B,C First, second, third anti-rotation feature
60 Elevation
62 Circumferential contour
65 Blow-molding preform
64 Concavity
66 Burls
68 Holding collar
70 First positioning element
72 Second positioning element
a Bending angle
h Height

The invention claimed is:

1. A plastic bottle, comprising:

a bottle container having a bottle shoulder and a bottle neck projecting from said bottle shoulder;

an attachment snap-connected, in a plug-fitting direction, with said bottle neck, said bottle neck having a first snap connection element and said attachment having a second snap connection element;

said attachment being an adapter attachment having an adapter neck for plug-fitting a closure cap; and an anti-rotation feature configured between said attachment and said bottle container, said anti-rotation feature including:

two snap connection elements which, selectively or in combination, engage in one another such that said snap connection elements configure a form-fit acting in a circumferential direction and defining a first anti-rotation feature;

a first toothing, defining a second anti-rotation feature, configured circumferentially on said bottle neck; and said bottle shoulder having an elevation which conjointly with said attachment configures a form-fit that acts in the circumferential direction and defines a third anti-rotation feature.

2. The plastic bottle according to claim 1, wherein said attachment is an angular adapter attachment and said adapter neck has an angled orientation relative to said bottle neck of said bottle container.

3. The plastic bottle according to claim 1, wherein at least two of said first, second, and third anti-rotation features are effective mutually independently of one another.

4. The plastic bottle according to claim 1, wherein said second and third anti-rotation features are combined with one another.

5. The plastic bottle according to claim 4, wherein said elevation circumferentially has at least one first securing element that extends in the radial direction, a corresponding second securing element of said attachment, interacting with said first securing element in order for the third anti-rotation feature to be configured.

6. The plastic bottle according to claim 5, wherein said first securing element is a concavity and said second securing element is a burl interacting with said concavity.

7. The plastic bottle according to claim 1, wherein said elevation, viewed in cross section, has a circumferential contour that deviates from a circular shape, and wherein said attachment bears on said circumferential contour to form the third anti-rotation feature.

8. The plastic bottle according to claim 1, wherein said elevation, in relation to a rotation about the plug-fitting direction by 180°, is configured non-symmetrical.

9. The plastic bottle according to claim 1, wherein said anti-rotation feature is configured to enable a rotationally fixed positioning of said attachment relative to said bottle neck in rotational steps of less than or equal to 5°.

10. The plastic bottle according to claim 1, wherein said second toothing comprises a plurality of second teeth formed externally on said bottle neck.

11. The plastic bottle according to claim 1, wherein said first toothing or said second toothing on said bottle neck extends only across part-regions of the circumference.

12. The plastic bottle according to claim 1, wherein said bottle neck and said attachment engage in one another by way of a first toothing that is configured between said two snap connection elements.

13. The plastic bottle according to claim 1, wherein said first toothing is formed by said snap connection elements that engage in one another in the plug-fitting direction.

14. The plastic bottle according to claim 1, wherein said first toothing is formed by said snap connection elements engaging in one another in the radial direction.

15. The plastic bottle according to claim 1, wherein said bottle container and said attachment each has a preferred orientation in relation to a rotation about the plug-fitting direction, and said attachment is snap-connected in a predefined rotational orientation in relation to said bottle container.

16. An attachment, comprising a second snap closure element configured for snap-connecting to a bottle neck of a bottle container of a plastic bottle according to claim 1.

17. A bottle container, comprising a bottle neck and a first snap closure element for a plastic bottle according to claim 1.

* * * * *